US010871335B2

(12) United States Patent
Dolderer et al.

(10) Patent No.: US 10,871,335 B2
(45) Date of Patent: Dec. 22, 2020

(54) HEAT EXCHANGER

(71) Applicant: Mahle International GmbH, Stuttgart (DE)

(72) Inventors: Axel Dolderer, Grossbottwar (DE); Gottfried Duerr, Ludwigsburg (DE); Richard Goce, Stuttgart (DE); Harald Muehleisen, Leinfelden-Echterdingen (DE); Benjamin Nothdurft, Stuttgart (DE); Markus Pflieger, Stuttgart (DE)

(73) Assignee: Mahle International GmbH

( * ) Notice: Subject to any disclaimer, the term of this patent is extended or adjusted under 35 U.S.C. 154(b) by 132 days.

(21) Appl. No.: 16/166,062

(22) Filed: Oct. 19, 2018

(65) Prior Publication Data

US 2019/0120569 A1 Apr. 25, 2019

(30) Foreign Application Priority Data

Oct. 20, 2017 (DE) ..... 10 2017 218 818

(51) Int. Cl.
*F28F 9/26* (2006.01)
*F28F 9/02* (2006.01)
(Continued)

(52) U.S. Cl.
CPC ..... *F28F 9/0253* (2013.01); *F28D 1/05341* (2013.01); *F28D 1/05391* (2013.01);
(Continued)

(58) Field of Classification Search
CPC ..... F28F 9/0253; F28F 9/0202; F28F 9/0204; F28F 9/0224; F28F 9/0229; F28F 17/005;
(Continued)

(56) References Cited

U.S. PATENT DOCUMENTS 3,480,077 A * 11/1969 Stevens ..... C01B 25/003 165/111
6,449,979 B1 * 9/2002 Nagasawa ..... F28D 1/0391 62/503
(Continued)

FOREIGN PATENT DOCUMENTS

DE 60010377 T2 9/2004
DE 102007007571 A1 9/2007
(Continued)

OTHER PUBLICATIONS

English abstract for DE-102007007571.

*Primary Examiner* — Claire E Rojohn, III
(74) *Attorney, Agent, or Firm* — Fishman Stewart PLLC

(57) ABSTRACT

A heat exchanger may include a first collecting tank and a second collecting tank. The first collecting tank may include a first collecting pipe having a first collecting pipe opening for letting in a fluid and a second collecting pipe having a second collecting pipe opening for discharging the fluid. The second collecting tank may be arranged opposite the first collecting tank and may include a third collecting pipe and a fourth collecting pipe. The heat exchanger may also include a plurality of heat exchanger pipes fluidically connecting the first collecting pipe to the third collecting pipe and the second collecting pipe to the fourth collecting pipe. The heat exchanger may also include a separating wall arranged in each of the first collecting pipe and the second collecting pipe respectively dividing each into a first pipe section and a second pipe section.

20 Claims, 5 Drawing Sheets

(51) Int. Cl.
*F28D 1/053* (2006.01)
*F28F 17/00* (2006.01)
*F28D 21/00* (2006.01)

(52) U.S. Cl.
CPC ..... *F28F 9/0202* (2013.01); *F28F 9/0204* (2013.01); *F28F 9/0224* (2013.01); *F28F 9/0229* (2013.01); *F28F 17/005* (2013.01); *F28D 2021/0071* (2013.01); *F28D 2021/0085* (2013.01); *F28F 2009/0292* (2013.01)

(58) Field of Classification Search
CPC ..... F28F 2009/0292; F28D 1/05341; F28D 1/05391; F28D 2021/0071; F28D 2021/0085
USPC ..... 165/144
See application file for complete search history.

(56) References Cited

U.S. PATENT DOCUMENTS 7,886,812 B2 * 2/2011 Higashiyama ..... F28F 9/0202 165/174
7,926,853 B2 4/2011 Katoh et al.
9,976,784 B2 * 5/2018 Hirayama ..... F25B 39/02
2005/0103486 A1 * 5/2005 Demuth ..... F28D 1/05391 165/174
2007/0131392 A1 * 6/2007 Minami ..... F28D 1/0391 165/110
2007/0131398 A1 * 6/2007 Ichiyanagi ..... F28D 1/05375 165/153
2007/0205598 A1 * 9/2007 Katoh ..... F28D 1/05391 285/30
2010/0077794 A1 * 4/2010 Higashiyama ..... F25B 39/022 62/515
2015/0292816 A1 * 10/2015 Mastroianni ..... F24F 1/36 62/285
2017/0157527 A1 * 6/2017 Kopel ..... F28B 9/08
2018/0112923 A1 * 4/2018 Liu ..... F28F 1/128
2018/0135915 A1 * 5/2018 Kester ..... F28F 9/0275

FOREIGN PATENT DOCUMENTS

DE 102015210184 A1 12/2016
JP 2002147992 A * 5/2002

* cited by examiner

HEAT EXCHANGER

CROSS-REFERENCE TO RELATED APPLICATION

This application claims priority to German Application No. DE 10 2017 218 818.9 filed on Oct. 20, 2017, the contents of which are hereby incorporated by reference in its entirety.

TECHNICAL FIELD

The present invention relates to a heat exchanger, in particular an evaporator, for an air conditioning system, which has two collecting tanks, which are fluidically connected to one another via heat exchanger pipes.

BACKGROUND

During operation, a first fluid, for example a coolant, as well as a second fluid, for example air, flows through a generic heat exchanger, so that a heat exchange takes place between the two fluids. The heat exchanger, through which the first fluid flows, typically has heat exchanger pipes, through which the second fluid flows, so as to realize the heat exchange between the fluids.

Such a heat exchanger is known from DE 10 2015 210 184 A1. The heat exchanger has two heat exchanger bodies, which each have two collecting pipes and heat exchanger pipes, wherein a separating wall, which regulates a flow of a coolant through the heat exchanger body, is provided in the respective heat exchanger body. Air thereby flows around the heat exchanger bodies, so that the heat exchange takes place between the coolant and the air.

It is desirable to provide a simplified setup for such heat exchangers and to design them more efficiently.

SUMMARY

The present invention thus deals with the object of specifying an improved or at least alternative embodiment for a heat exchanger of the above-mentioned type, which is in particular characterized by a simplified setup and/or an improved efficiency.

This object is solved according to the invention by means of the subject matter of the independent claim(s). Advantageous embodiments are the subject matter of the dependent claim(s).

The present invention is based on the general idea of providing a heat exchanger comprising two collecting tanks located opposite one another with two collecting pipes each, which are fluidically connected to one another via heat exchanger pipes, wherein the collecting pipes of one of the collecting tanks are each provided with a separating wall, so that a fluid, which flows through the collecting tanks and heat exchanger pipes, in particular a coolant, flows through the heat exchanger across a total of four flow paths. On the one hand, this leads to a simplified setup of the heat exchanger. On the other hand, it is thus possible to dimension the heat exchanger pipes to be smaller and/or to arrange them at a larger distance to one another, so that the flow resistance for a fluid, for example air, which flows around the heat exchanger pipes, is reduced, so that the energy consumption for operating the heat exchanger or a corresponding application, in particular an air conditioning system, is reduced. According to the idea of the invention, the heat exchanger has a first collecting tank comprising a first collecting pipe and a second collecting pipe, as well as a second collecting tank comprising a first collecting pipe and a second collecting pipe. For a better differentiation, the collecting pipes of the second collecting tank will also be referred to as third collecting pipe and fourth collecting pipe below. The first collecting pipe has a first collecting pipe opening for letting in a fluid, in particular coolant, and the second collecting pipe has a second collecting pipe opening for discharging the fluid, in particular the coolant. The heat exchanger pipes fluidically connect the first collecting pipe to the third collecting pipe and the second collecting pipe to the fourth collecting pipe. A separating wall, which divides the corresponding collecting pipe into a first pipe section and a second pipe section, is thereby in each case arranged in the first collecting pipe and in the second collecting pipe. This means that the separating wall of the first collecting pipe divides the first collecting pipe into a first pipe section and a second pipe section, while the separating wall of the second collecting pipe divides the second collecting pipe into a first pipe section and a second pipe section. The second pipe section of the first collecting pipe and the second pipe section of the second collecting pipe are hereby fluidically connected to one another in the first collecting tank in such a way that the fluid flows in via the first collecting pipe opening and flows through the first pipe section of the first collecting pipe and subsequently reaches the third collecting pipe via heat exchanger pipes, wherein the fluid flows from the third collecting pipe via heat exchanger pipes to the second section of the first collecting pipe, and from there to the second pipe section of the second collecting pipe. The fluid subsequently flows to the fourth collecting pipe via heat exchanger pipes and subsequently via heat exchanger pipes to the first pipe section of the second collecting pipe, where it escapes via the second collecting pipe opening.

It is preferred when the first pipe section of the first collecting pipe includes the first collecting pipe opening, while the first pipe section of the second collecting pipe includes the second collecting pipe opening.

Embodiments, in the case of which at least one of the collecting pipe openings of the first collecting tank is arranged on the front side of the corresponding collecting pipe, in particular of the collecting tank, are advantageous. The collecting pipes can be produced in a simplified manner and/or can be fluidically supplied thereby.

It is advantageous when first heat exchanger pipes fluidically connect the first pipe section of the first collecting pipe to the third collecting pipe, while second heat exchanger pipes, which differ from the first heat exchanger pipes, connect the third collecting pipe to the second pipe section of the first collecting pipe. It is furthermore preferred when third heat exchanger pipes, which differ from the first and second heat exchanger pipes, fluidically connect the second pipe section of the second collecting pipe to the fourth collecting pipe. It is furthermore preferred when fourth heat exchanger pipes, which differ from the first, second and third heat exchanger pipes, fluidically connect the fourth collecting pipe to the first pipe section of the second collecting pipe.

On principle, the respective heat exchanger pipes can hereby be embodied arbitrarily. It is preferred thereby, when the heat exchanger pipes have an identical form and/or identical dimensioning. The respective heat exchanger pipe can in particular be embodied as flat pipe.

On principle, the respective separating wall can completely separate the two pipe sections fluidically in the corresponding collecting pipe inside the collecting pipe.

Embodiments, in the case of which at least one of the separating walls has a separating wall opening, which accounts for a partial cross section of the entire separating wall, so that a small flow of the fluid between the corresponding pipe sections is possible, are also conceivable. In particular a pressure compensation between the pipe sections, in particular in the manner of a throttle, can thus be attained.

In the case of the preferred embodiments, the respective collecting pipe has a flattened bottom, in which the heat exchanger pipes are accommodated. It is advantageous thereby when the respective bottom has passages, which are directed to the outside, that is towards the heat exchanger pipes, for accommodating the heat exchanger pipes. It is conceivable thereby that the respective heat exchanger pipe has a shoulder, which protrudes on the outer side, with which the heat exchanger pipe strikes against the corresponding collecting pipe on the front side. In particular a penetration depth of the heat exchanger pipe into the collecting pipe can be limited thereby, so that the volume, which can be flown through in the collecting pipe, is increased.

It is preferred when the passages are produced by a tearing of the bottom, thus in particular torn to the outside. This allows for a cost-efficient production of the collecting tank and for an optimized utilization of the available volume.

Embodiments, in the case of which the passages protrude from the corresponding bottom by less than 3 mm, are considered to be preferred. The passages thus have a height of less than 3 mm. Heights of less than 2.5 mm and 2.2 mm are particularly preferred, a height of 2 mm is very much preferred.

The bottoms of at least one of the collecting tanks are preferably arranged at an incline relative to one another in the manner of a gabled roof or of an upside-down channel, respectively, so that the entire surface of the respective bottom outside of the accommodations or of the heat exchanger pipes, respectively, is on principle used for a specific and improved drainage of condensate, which arises on the bottom. A larger surface is thereby available for discharging the condensate, so that condensate can be discharged in an improved manner as a whole and an improved efficiency of the collecting tank or of the heat exchanger, respectively, is thus attained. In addition, recesses or indentations, respectively, in the collecting tank for discharging the condensate are not necessary, so that, on the one hand, the production of the collecting tank and thus of the heat exchanger is simplified and becomes more cost-efficient and, on the other hand, a smaller volume is sufficient for the condensate discharge, so that the collecting tank and the heat exchanger can be produced more cost-efficiently and so as to save more installation space. The bottoms thus run at an inline to one another and thus form an angle $\alpha$, which is not equal to 180°.

The incline of the bottoms preferably applies in installation position of the collecting tank or of the heat exchanger, respectively, relative to the gravitational direction, so that accumulating condensate can flow along the respective bottom as a result of the incline. This means in particular that the respective bottom in installation position preferably does not form a right angle with the gravitational direction. The incline of the bottoms further applies such that they are inclined in the cross section, in particular evenly.

It is preferred when the bottoms are each embodied as a flat plate comprising the respective accommodations. This allows for a particularly cost-efficient production of the collecting tank as well as an efficient discharge of accumulating condensate.

Embodiments, in the case of which the bottoms, which are inclined towards one another, draw and form an angle $\alpha$ between 177° and 171°, preferably of 174° relative to one another, prove to be advantageous. Such an angle has proven to be capable of being realized particularly easily and particularly effectively for discharging the accumulating condensate. In addition, the collecting tank can be produced in an installation space-saving manner with such an angle. However, smaller angles $\alpha$ are conceivable as well. The angle $\alpha$ is preferably attained in that the respective bottom in installation position relative to the perpendicular course to the gravitational direction differs by at least 1.5°, in particular by 3°, is inclined to the gravitational direction between 85.5° and 88.5°, in particular by 87°.

On principle, the incline of the bottoms relative to one another is embodied arbitrarily. It is conceivable that the bottoms are inclined all the way to the corresponding hollow space.

Alternatives, in the case of which the bottoms are inclined away from the corresponding hollow space, are also conceivable. In this case, the angle $\alpha$ would then be greater than 180°.

The coolant can flow through the hollow space of the respective collecting pipe. A flow cross section of the respective collecting pipe is thereby preferably bounded or formed, respectively, by the bottom and a wall connected to the bottom.

Alternatives, in the case of which the wall has a circular section in the shape of a circular segment located opposite the corresponding bottom and transition sections connected thereto on both sides, which transition into the bottom, thereby prove to be advantageous. The respective transition section is thereby formed and embodied in such a way that the circular section, together with the transition sections, bounds or defines an Ω-shaped flow cross section or a flow cross section close thereto, respectively. This allows in particular to realize a fluidic supply of the collecting pipe, which preferably takes place at an end of the collecting pipe or on the front side of the collecting pipe, respectively, or of the collecting tank, in a particularly effective manner and with reduced pressure losses.

Embodiments, in the case of which at least one of the passages, preferably the respective passage, has a front side, which faces away from the corresponding bottom and which runs in a curved manner, prove to be advantageous. The curved course thereby applies in particular in the transverse direction or transversely to the distance direction of the passages, respectively. Particularly preferably, the front sides are curved convexly relative to the corresponding bottom in such a way that a central area of the front side is spaced apart farther from the bottom than outer areas of the passage, which run in the transverse direction. Such a curved course of the passage or of the front side, respectively, allows in particular to contact corrugated fins arranged in the heat exchanger between the heat exchanger pipes at the further areas of the front sides, which protrude from the bottom, with the heat exchanger pipes and the front sides, and to thus provide an enlarged contact area between the corrugated fins and the heat exchanger pipes, so that the heat exchanger as a whole has an increased efficiency and/or can be produced in a more installation space-saving manner.

To mechanically reinforce the collecting tank, in particular the respective collecting pipe, the collecting tank can be provided with beads, in particular reinforcing beads. The respective collecting pipe is preferably provided with a plurality of such beads, which are advantageously introduced so as to be located opposite to the bottom, in particular in the wall, preferably in the circular section. In addition, the beads of the respective collecting pipe are advantageously spaced apart in the distance direction of the corresponding tank accommodations and thus in particular in the longitudinal direction. This provides for a particularly effective and simple mechanical stabilizing of the collecting tank.

It is particularly advantageous when both collecting pipes have such beads, wherein one bead of the first collecting pipe and one bead of the second collecting pipe each touch one another in an area between both collecting pipes or are in mechanical contact, respectively. The beads, which touch one another, can in particular run in parallel. Such an embodiment of the collecting tank has proven to be particularly stable. This mechanical stability is improved when the area between the two collecting pipes is a central seam of the collecting tank, at which the walls of the collecting pipes, in particular a transition section of one of the collecting pipes, is in contact with the transition section of the other collecting pipe. A mechanical stabilization is thereby attained across an increased height of the collecting tank.

On principle, the collecting pipes of the collecting tank can be produced separately and can subsequently be attached to one another, in particular connected to one another.

Preferred embodiments provide for the integral production of both collecting pipes, in particular of the entire collecting tank. The collecting pipes are thus produced monolithically or of the same base material, respectively. The collecting pipes can in particular be made of one sheet metal part, in particular by forming the sheet metal part. The collecting pipes are thus in particular made of the same sheet metal part, which is processed to produce the collecting pipes, in particular deformed, and which is provided with the collecting tank accommodations. The collecting tank, in particular the inclined course of the bottoms, can thus be realized in a cost-efficient and simple manner. In addition, the tank accommodations can thus be introduced into the respective bottom in a simplified manner. The sheet metal part can have a thickness of less than 1.2 mm, for example 1 mm or less, for example 0.9 mm or less, in particular between 0.8 mm and 0.9 mm, for example 0.8 mm.

The respective collecting tank can have a tank height, which is less than 48 mm, in particular less than 46 mm, for example between 40 mm and 43 mm, in particular between 41.5 mm and 42.5 mm.

A height of a net of the heat exchanger 9, which consists of the heat exchanger pipes and corrugated fins, or net height, is preferably less than 45 mm, in particular less than 42 mm. Advantageously, the net height is between 39 mm and 40 mm, in particular between 39.4 mm and 40 mm.

One of the collecting tanks, preferably the first collecting tank, is preferably fluidically supplied via a connector assembly.

The connector assembly advantageously has a base plate and an outer shell, which establish a fluidic connection between at least one supply pipe body of the connector assembly and the collecting tank and accommodate the supply pipe body. This provides for a simple, cost-efficient as well as installation space-saving embodiment of the connector assembly and of the heat exchanger. A separate assembly or a separate connection of the supply pipe body, for example with the help of a flange, can furthermore be forgone thereby, so that a simplified production and assembly is attained thereby as well. Accordingly, the connector assembly has the base plate as well as the outer shell, wherein the base plate has two plate openings for fluidic connection to the collecting tank, wherein a first plate opening is fluidically connected to the first collecting pipe and a second plate opening to the second collecting pipe. The outer shell is arranged on the side of the base plate facing away from the collecting tank. The assembly furthermore has two supply pipe bodies for fluidically supplying the collecting tank via the respective plate opening. The base plate and the outer shell each form a pipe-shaped pipe accommodation for the supply pipe bodies. An in particular pipe-shaped adapter element, via which the supply pipe body is accommodated in the corresponding pipe accommodation, is thereby arranged on the respective supply pipe body. Compared to the solutions known from the prior art, in the case of which a supply pipe body needs to be fastened to a pipe socket with the help of additional means, such a fastening can be forgone in the case of the present invention.

In the present case, supply is understood to be the supplying of a fluid, in particular of a coolant, and/or the discharging of the fluid. The fluidic supply of the collecting tank by the connector assembly thus means that the fluid is supplied to the collecting tank via the connector assembly and is discharged from the collecting tank.

The respective plate opening of the base plate can be embodied arbitrarily. It is preferred when at least one of the plate openings, in particular the respective plate opening of the base plate, is embodied as an aperture or a bore in the plate opening.

On principle, the adapter element can be a separately produced component, which is fluidically and mechanically connected to the corresponding supply pipe body.

It is also conceivable that the adapter element is produced integrally of one piece, in particular monolithically, with the corresponding supply pipe body, in particular in such a way that a separate connection between the adapter element and the corresponding supply pipe body can be forgone.

The respective adapter element can in particular differ from the remaining supply pipe body by its outer jacket surface. The outer jacket surface can in particular be formed in such a way that an accommodation of the adapter element in the corresponding pipe accommodation is possible.

Embodiments, in the case of which at least one of the adapter elements, preferably the respective adapter element, is accommodated in the corresponding pipe accommodation in a positive manner, in particular enclosed, are particularly preferred. This allows for a stable connection of adapter element and supply pipe body with the corresponding pipe accommodation. The positive surrounding of the adapter element furthermore leads to a sealing effect, so that further sealing elements can be forgone or can be embodied in a simpler way.

In the case of advantageous embodiments, the base plate for forming the respective pipe accommodation has a plate molding, which forms the pipe accommodation with a corresponding shell molding of the outer shell. The respective molding can thereby in particular be embodied as an impression of the base plate or of the outer shell, respectively. The connector assembly can be produced in a simple and cost-efficient as well as in a space-saving manner in this way.

Embodiments, in the case of which the outer shell has a duct section, which is associated with the respective pipe accommodation and which serves for the fluidic connection between the pipe accommodation and the corresponding plate opening of the base plate, are considered to be preferred. The duct section, together with the base plate, thus forms a corresponding supply duct, which leads from the pipe accommodation to the corresponding plate opening of the base plate. It is preferred hereby when the respective duct section of the outer shell is embodied as a molding, whereas the base plate for forming the supply duct does not have any deformations. It is advantageous for this purpose when the outer shell is spaced apart from the base plate with the duct section and abuts on the base plate on the edge side of the duct section. Advantageously, the supply ducts are fluidically separated from one another inside the connector assembly. This means that the supply bodies are fluidically connected to the corresponding pipe accommodation, the corresponding supply duct, as well as the corresponding plate opening, and are fluidically separated from other pipe accommodations, supply ducts and plate openings inside the connector assembly. It is thus preferred when the base plate has a first plate opening, which is associated with the first collecting pipe, as well as a second plate opening, which is associated with the second collecting pipe, wherein the respective plate opening is fluidically connected to the corresponding collecting pipe. The base plate and the outer shell thereby form a first pipe accommodation for a first supply pipe body, which is fluidically connected to the first plate opening and thus to the first collecting pipe. In addition, the base plate and the outer shell form a second pipe accommodation for a second supply body, which is fluidically connected to the second plate opening and thus to the second collecting pipe. The fluidic connection between the respective pipe accommodation and the corresponding plate opening is advantageously realized via a supply duct of the described type.

Both plate openings can thereby be embodied identically, they can in particular have an identical size and form. Embodiments, in the case of which the first plate opening has a smaller flow cross section than the second plate opening, are also conceivable. In particular when a fluid is introduced into the corresponding collecting pipe via the first plate opening and when the fluid is sucked from the second collecting pipe via the second plate opening, advantageous flows result thereby, in particular smaller pressure losses, which lead to an increased efficiency and/or a lower energy consumption for conveying the fluid, in particular of the coolant.

Embodiments, in the case of which the base plate, the outer shell as well as the adapter elements are connected to one another by means of a joint integral joining process, are advantageous. This means that the base plate, the outer shell as well as the adapter elements are produced separately and are joined to one another subsequently. The respective adapter element can in particular be placed into the corresponding plate molding or shell molding, respectively, and the base plate as well as the outer shell can subsequently be brought into contact so as to form the assembly. It is thus in particular ensured that the respective adapter element is fixed in the corresponding pipe accommodation by means of a positive connection. The integral joining takes place subsequently, wherein the outer shell can first be fixed relative to the base plate by means of a positive connection, wherein the outer shell can be crimped to the base plate for this purpose.

A soldering process, in the case of which the base plate, the outer shell, as well as the adapter elements are connected to one another integrally, is thereby considered to be a preferred joining method. The outer shell can thereby be solder-plated on both sides or on the side facing the base plate. The base plate can also have a solder-plating, wherein the solder-plating preferably comprises a low solder portion, for example less than 5% solder, so as to prevent or so as to at least reduce damages to the adjacently arranged heat exchanger, in particular of corrugated fins of the heat exchanger.

At least one of the pipe accommodations, preferably the respective pipe accommodation, and the corresponding plate opening are advantageously located in planes, which run at an incline relative to one another, in particular perpendicularly. In other words, at least one of the pipe accommodations extends along the base plate or that section of the base plate, respectively, in which the corresponding plate opening is arranged. A compact construction of the assembly can be realized thereby. It is in particular conceivable that the supply pipe body and the collecting tank, in particular the corresponding collecting pipe, run at an incline relative to one another, in particular transversely relative to one another. This has the result that the corresponding supply duct has a curved course, in particular a course curved by 90°, so as to establish a fluidic connection between the pipe accommodation and the plate opening.

Preferred embodiments provide that the second plate opening has a cross section, which is complementary to the circular section of the second collecting pipe or of the second collecting pipe opening, respectively, and is arranged aligned with the circular section and is fluidically connected to the second collecting pipe opening. The fluid, in particular the coolant, can thereby be conveyed, particular sucked, from the second collecting pipe with an increased efficiency.

The fluidic connection between the respective plate opening and the corresponding collecting pipe opening advantageously takes place directly, for example in that the base plate abuts on the front side of the corresponding collecting pipe, in particular of the collecting tank, in particular in the area of the respective plate opening. The heat exchanger can thus be produced in an installation space-saving and cost-efficient manner. This furthermore leads to a smaller flow resistance for the fluid, which flows through the collecting pipes or the connector assembly, respectively, and to smaller heat losses, so that the efficiency of the heat exchanger is improved.

It is advantageous when the base plate abuts on the front side of the first collecting tank, and the respective plate opening is arranged aligned with the corresponding collecting pipe opening and is directly fluidically connected to the latter.

On principle, the heat exchanger can be used in an arbitrary application. The heat exchanger is in particular an evaporator, in the case of which a coolant flows through the collecting tank and heat exchanger pipes, and in the case of which a gas, in particular air, flows around the heat exchanger pipes. The evaporator can thereby in particular be used in an air conditioning system, for example of a vehicle.

The collecting tank has a height, which extends transversely to the transverse direction and transversely to the longitudinal direction and which is approx. 16 mm without passages directed to the outside, and approx. 17 mm with passages directed to the outside. This means that the passages, which are directed to the outside, have a height of approx. 1 mm or protrude from the corresponding bottom, respectively.

Further important features and advantages of the invention follow from the subclaims, from the drawings, and from the corresponding figure description by means of the drawings.

It goes without saying that the above-mentioned features, and the features, which will be described below, cannot only be used in the respective specified combination, but also in other combinations or alone, without leaving the scope of the present invention.

Preferred exemplary embodiments of the invention are illustrated in the drawings and will be described in more detail in the description below, wherein identical reference numerals refer to identical or similar or functionally identical components.

BRIEF DESCRIPTION OF THE DRAWINGS

In each case schematically.

DETAILED DESCRIPTION

Figure 1:
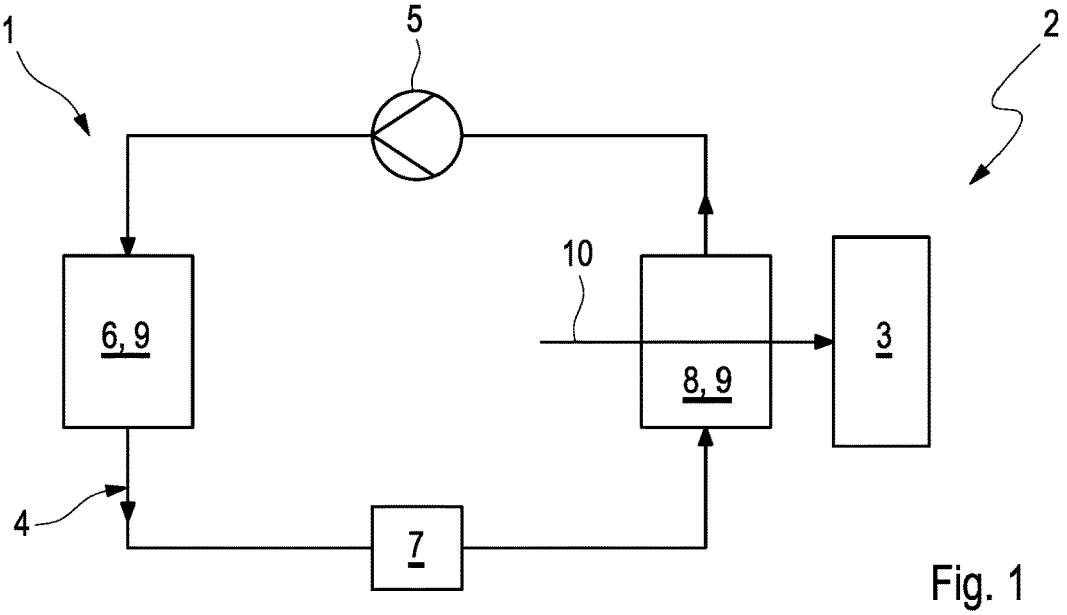
FIG. 1 shows a highly simplified, circuit diagram-like illustration of an air conditioning system in a vehicle.

An air conditioning system 1, which can be used in a vehicle 2, so as to climatize for example a vehicle interior 3 of the vehicle 2, is illustrated in FIG. 1 in a highly simplified manner. The air conditioning system 1 has a circuit 4, in which a coolant is driven by a conveying device 5 and circulates. The coolant thereby flows through a capacitor 6, an expander 7, as well as an evaporator 8 in succession, wherein the capacitor 6 and the evaporator 8 in each case act as a heat exchanger 9. The coolant and a further fluid flows through the respective heat exchanger 9 in such a way that a heat exchange results between the coolant and the further fluid. In the case of the evaporator 8, the further fluid is air 10, which flows through the evaporator 8 and is cooled thereby, wherein the cooled air 10 is supplied to the vehicle interior 3.

Figure 2:
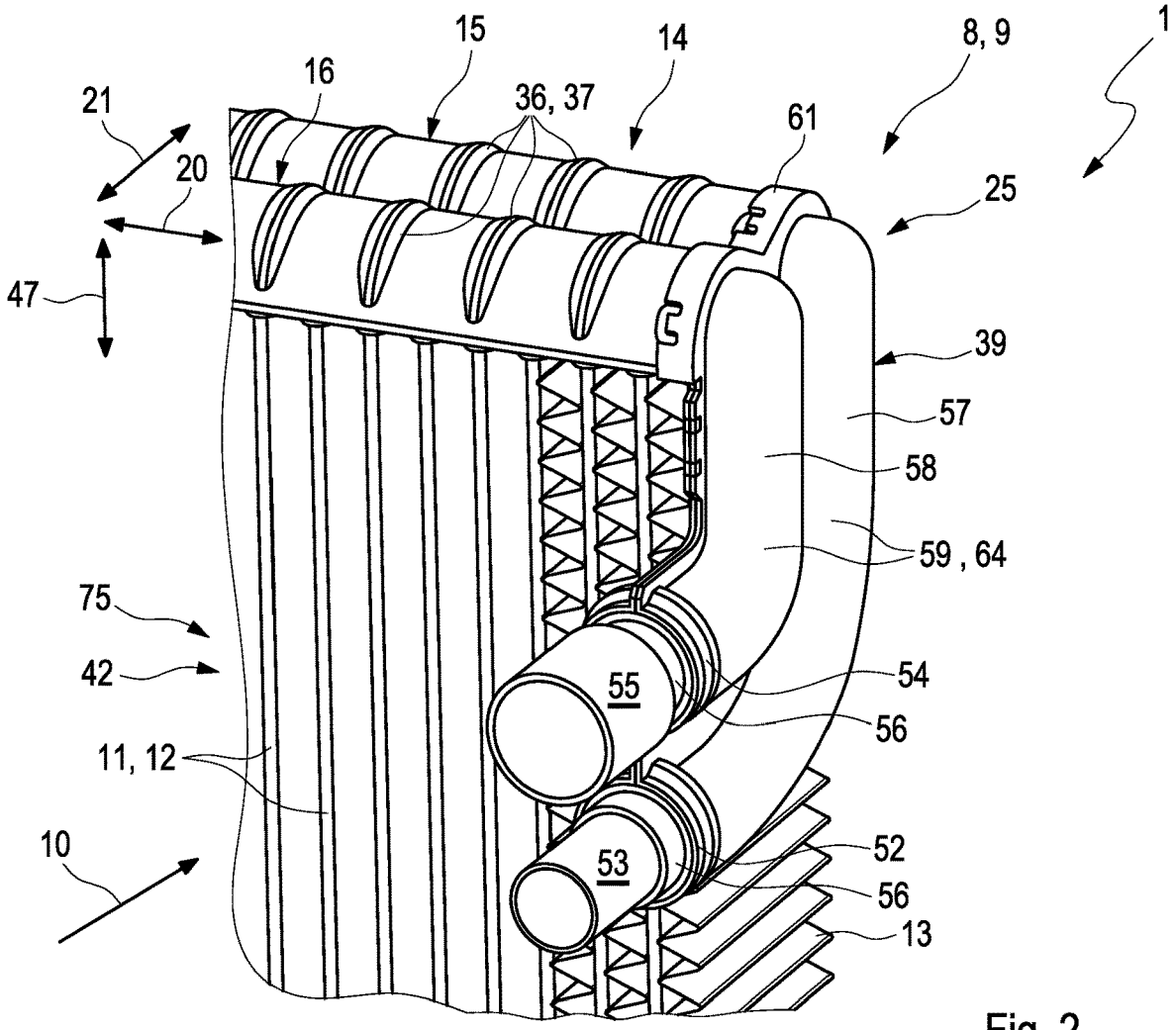
FIG. 2 shows an isometric partial view of a heat exchanger of the air conditioning system comprising a connector assembly.

FIG. 2 shows an isometric partial view of one of the heat exchangers 9, in particular of the evaporator 8. The heat exchanger 9 has a plurality of heat exchanger pipes 11, through which the coolant flows and which are arranged spaced apart from one another. In the shown example, the heat exchanger pipes 11 are embodied as flat pipes 12. As a result of the spaced-apart arrangement of the heat exchanger pipes 11, air 10 can flow between the heat exchanger pipes 11 and can thereby flow around them and can hereby exchange heat with the coolant, which flows through the heat exchanger pipes 11, and can thus be cooled. An improved heat exchange between the air 10 and the coolant can be attained in that corrugated fins 13, which can be flown through between adjacent heat exchanger pipes 11, are provided. The fluidic supply of the heat exchanger pipes 11 with the coolant takes place with the help of at least one collecting tank 14, wherein a collecting tank 14 can be seen at an upper end of the heat exchanger 8 in FIG. 2. At an opposite lower end, which is not shown, the heat exchanger 9 preferably has a further second collecting tank 14, which is not shown.

As follows from a combined view of FIG. 5 and FIG. 6, in which the corrugated fin 13 is suggested by a dashed line course and is illustrated in a transparent manner, the collecting tank 14 has two collecting pipes 15, 16, namely a first collecting pipe 15, and a second collecting pipe 16. On the side facing the heat exchanger pipes 11, the respective collecting pipe 15, 16 has a flattened pipe bottom 17, or bottom 17 in short. A wall 18 of the corresponding collecting pipe 15, 16, which bounds a hollow space 19 of the collecting pipe 15, 16, which can be flown through, with the bottom 17, connects at the respective bottom 17. The collecting pipes 15, 16 each run in a longitudinal direction 20 and thus essentially in parallel and are arranged adjacent to one another in a transverse direction 21, which runs transversely to the longitudinal direction 20, in particular so as to adjoin one another directly. The walls 18 of the collecting pipes 15, 16 thereby meet in a central area 22 of the collecting tank 14 in the transverse direction 21, and thus form a central seam 23 of the collecting tank 14, which is arranged centrally in the transverse direction 21 and which extends in the longitudinal direction 20. In the bottom 17, the respective collecting pipe 15, 16 has accommodations 24 for the heat exchanger pipes 11, which will also be identified below as tank accommodations 24. The tank accommodations 24 of the respective collecting pipe 15, 16 are spaced apart in the longitudinal direction 20 and in each case accommodate a heat exchanger pipe 11. In the shown example, the tank accommodations 24 of both collecting pipes 15, 16 are thereby arranged equidistant in the longitudinal direction 20, wherein a tank accommodation 24 of the second collecting pipe 16 is arranged adjacent to the respective tank accommodation 24 of the first collecting pipe 15 in the transverse direction 21 in such a way that two heat exchanger pipes 11, which are aligned with one another and which are spaced apart from one another in each case, are arranged in the transverse direction 21 and that this arrangement repeats itself in the longitudinal direction 20.

In the shown example, the coolant, which flows into the first collecting pipe 15 and in the heat exchanger pipes 11, which are arranged in the tank accommodations 24 of the first collecting pipe 15 and are thus fluidically connected thereto, is supplied to the first collecting pipe 15 via a connector assembly 25. The coolant flows through these heat exchanger pipes 11 and, in particular in the non-illustrated, opposite, lower or second collecting tank 14, respectively, is deflected into the heat exchanger pipes 11, which are accommodated in the tank accommodations 24 of the second collecting pipe 16, so that the coolant subsequently flows via these heat exchanger pipes 11 into the second collecting pipe 16, wherein the coolant is sucked from the second collecting pipe 16 via the connector assembly 25. The coolant is thus injected into the first collecting pipe 15 with the help of the conveying device 5, and is sucked from the second collecting pipe 16.

As a result of the heat exchange between the coolant, which flows through the heat exchanger pipes 11 and the collecting pipes 15, 16, and the air 10, the air 10 is cooled. As a result of the cooling of the air 10, condensate accumulates, which can in particular deposit on the bottom 17 of the respective collecting pipe 15, 16. As can in particular be gathered from FIGS. 5 and 6, wherein FIG. 6 only shows the collecting tank 14 in cross section, the bottoms 17 of the collecting pipes 15, 16 run at an incline relative to one another in the manner of a gabled roof or of an upside-down channel, so that they form a predetermined angle 26, hereinafter also referred to as angle α, of not equal to 180°. The respective bottom 17 is thereby inclined relative to the transverse direction 21, wherein said angle 26 is formed by the outer surface 27 of the bottoms 17 facing the heat exchanger pipes 11, which, with the exception of the tank accommodations 24, run in an essentially plane and in a plate-shaped manner, so that the bottoms 17 are each embodied as a plane plate 28. In an installation position 29 or use position 29, which is illustrated for example in FIGS. 5 and 6, the bottoms 17 are thereby also inclined relative to the gravitational direction G in such a way that, in the cross section with the gravitational direction G, they form an angle of smaller than 90°. In other words, the outer surfaces 27 of both bottoms 17 are inclined relative to the gravitational direction G in the installation position 29, so that condensate accumulating on the bottoms 17 can flow along the outer surface 27 in a simplified manner and can thus be discharged in a simplified manner. In the case of the example shown in FIGS. 5 and 6, both bottoms 17 are thereby inclined to the corresponding hollow space 19, so that the bottoms 17 or the outer surfaces 27, respectively, form an angle 26 or a, respectively, of smaller than 180°, in particular between 171° and 177°, advantageously of 174°, on the side facing the hollow spaces 19 or facing away from the heat exchanger pipes 11, respectively. The accumulating condensate can thus flow all the way to the central area 22. This accumulating condensate can then flow in the central area 22 or between the heat exchanger pipes 11, which are adjacent in the transverse direction 21, respectively, in the direction of the opposite, lower collecting tank 14, which is not shown, and can flow there to the outside from the central area 22 of this collecting tank in the transverse direction 21, where the condensate can flow away and/or is discharged.

Figure 4:
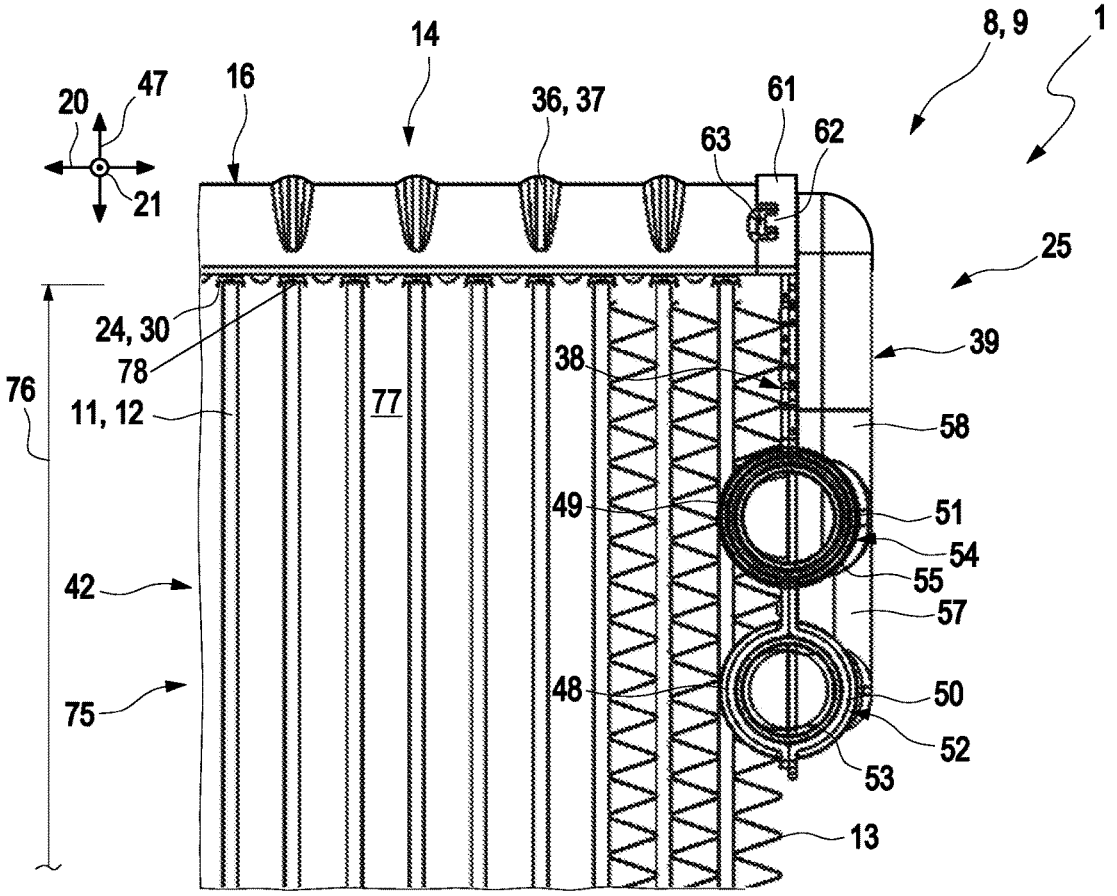
FIG. 4 shows a side view of the heat exchanger.
Figure 5:
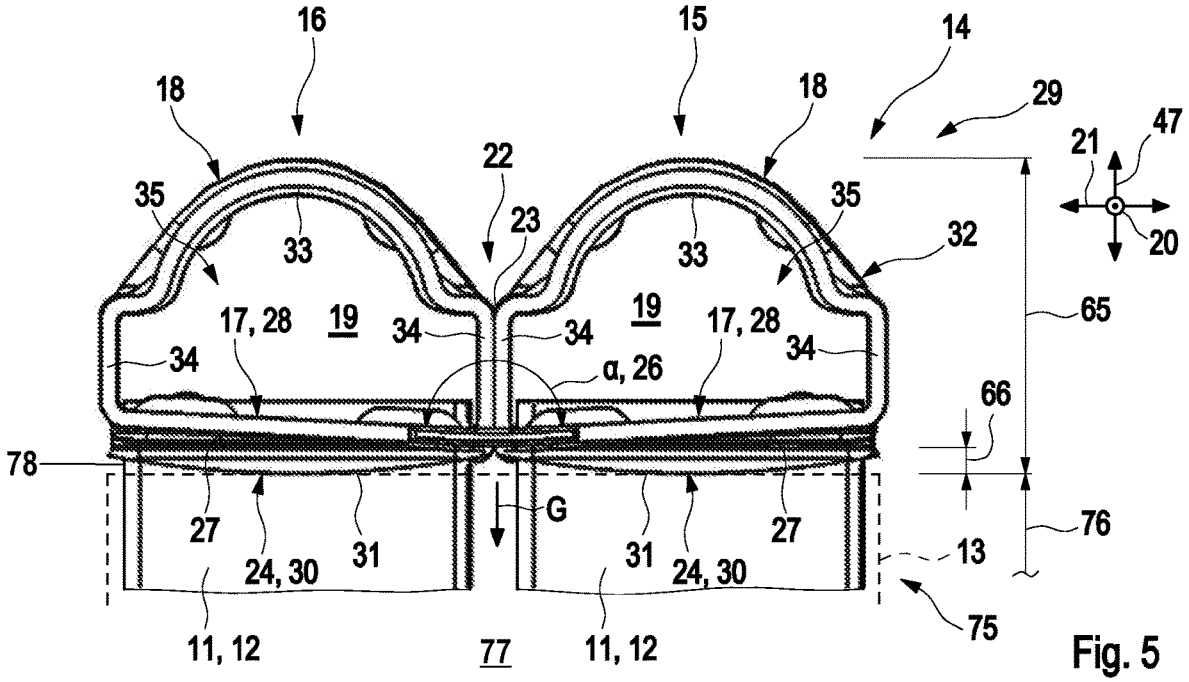
FIG. 5 shows a cross section through the heat exchanger in the area of a collecting tank.
Figure 6:
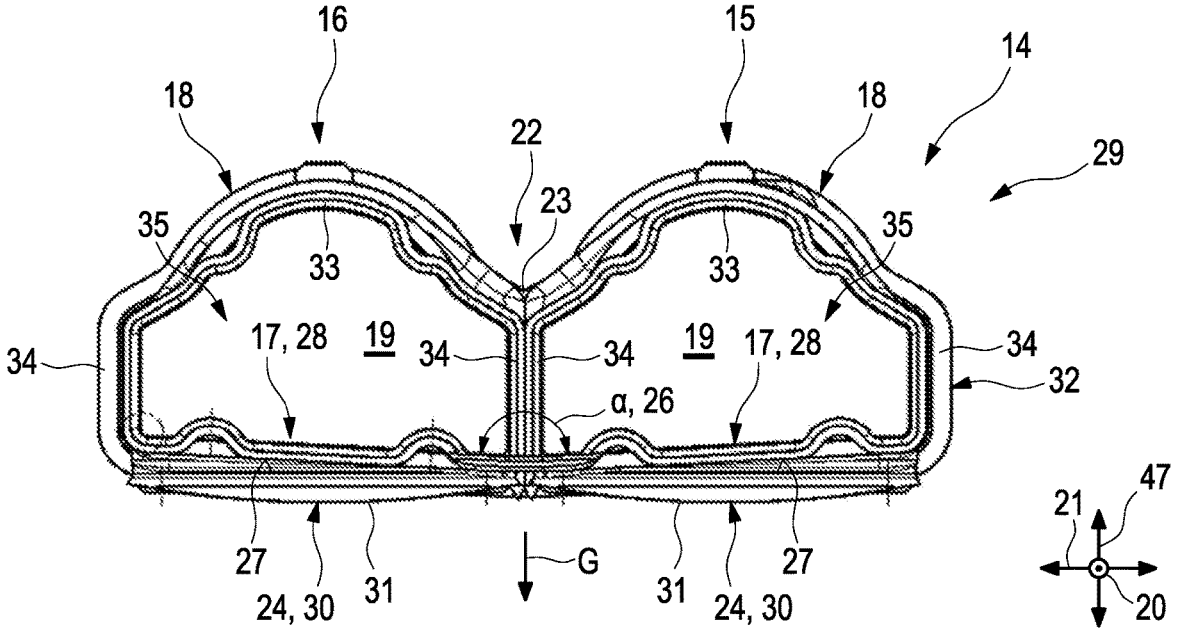
FIG. 6 shows a cross section through the collecting tank.

It can in particular be seen in FIGS. 4 to 6 as well as 8 that the tank accommodations 24 of the respective bottom 17 or of the collecting pipe 15, 16 respectively, are each formed by a passage 30, which can be produced by means of a tearing of the corresponding bottom 17. It can be seen thereby that the passages 30 are each directed away from the corresponding hollow space 19 and thus do not penetrate into the hollow space 19. The passages 30 may be directed to an outside 77 of the respective collecting pipes 15, 16, that is towards the heat exchanger pipes 11, for accommodating the heat exchanger pipes 11. The respective heat exchanger pipe 11 may have a shoulder 78, which protrudes on the outer side, with which the heat exchanger pipe 11 strikes against the corresponding collecting pipe 15, 16 on the front side 31. It is in particular possible hereby to insert the heat exchanger pipes 11 into the collecting pipes 15, 16 with a smaller penetration depth, so that the volume of the hollow space 19, which can be flown through or which can be used, respectively, is increased. It can furthermore be gathered in particular from FIGS. 5 and 6 that the passages 30 have front sides 31, which face away from the corresponding hollow space 19, wherein the front sides 31 run in a curved manner in the transverse direction 21, in particular curved in the shape of a circular segment. As can be gathered from FIG. 5, a reduced contact area results between the front side 31 and the adjacent corrugated fin 13 at the area of the front side 31, which protrudes the most. This volume can thus also be improved and can be used more efficiently for providing with the corrugated fins 13.

Figure 8:
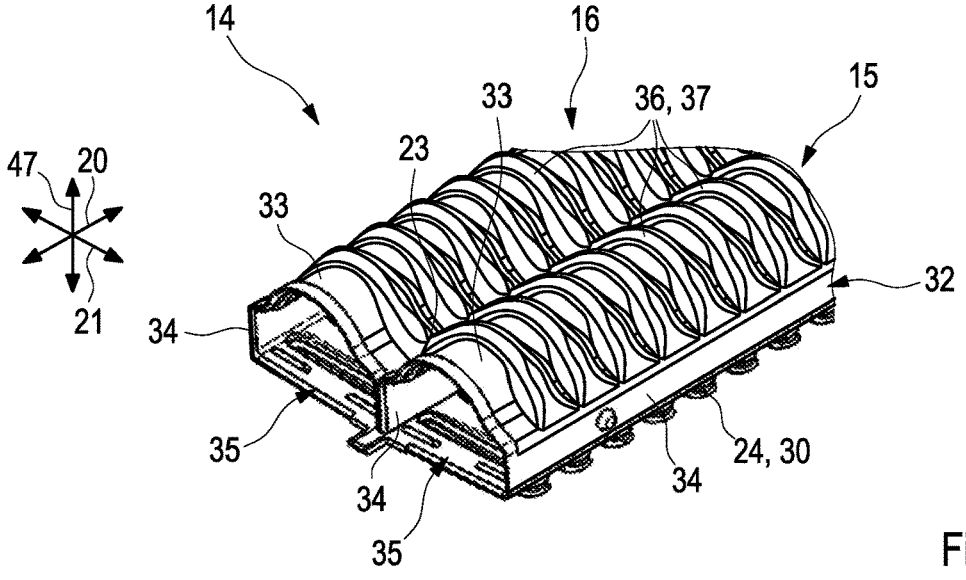
FIG. 8 shows an isometric partial view of the collecting tank.

As follows in particular from FIGS. 5, 6 and 8, the collecting tank 14 in the shown example is produced integrally from one sheet metal part 32 or by forming the sheet metal part 32, respectively. It can further be seen that the wall 18 of the respective collecting pipe 15, 16 has a circular section 33 in the shape of a circular segment located opposite the corresponding bottom 17, as well as transition sections 34, which connect to the circular section 33 on both sides and which transition into the bottom 17, wherein the circular section 33 and the transition sections 34 define a flow cross section 35 of the corresponding collecting pipe 15, 16 or the corresponding hollow space 19, respectively. The flow cross section 35 is thereby preferably Ω-shaped or is close to an Ω-shape, respectively, in the area of the circular section 33 and in the adjacent area of the corresponding transition sections 34. In the central area 22, a transition section 34 each of both collecting pipes 15, 16 adjoin one another and thus form the central seam 23.

On the side facing away from the heat exchanger pipes 11, in particular in the area of the wall 18, the respective collecting pipe 15, 16 has a plurality of beads 36, which will also be identified below as reinforcing beads 36. The reinforcing beads 36 are each embodied as indentations 37, which are directed to the outside. The reinforcing beads 36 run in the transverse direction 21 and are spaced apart from one another in the longitudinal direction 20. A reinforcing bead 36 of the first collecting pipe 15 and a reinforcing bead 36 of the second collecting pipe 16 thereby each meet in the central area 22 of the collecting tank 14 or in the area of the central seam 23, respectively, in which the transition sections 34 of the collecting pipes 15, 16 adjoin one another. An improved mechanical stability of the entire collecting tank is thus attained, also outside of the beads 36, in particular also in a height direction 47, which runs transversely to the longitudinal direction 20 and transversely to the transverse direction 21.

Figure 3:
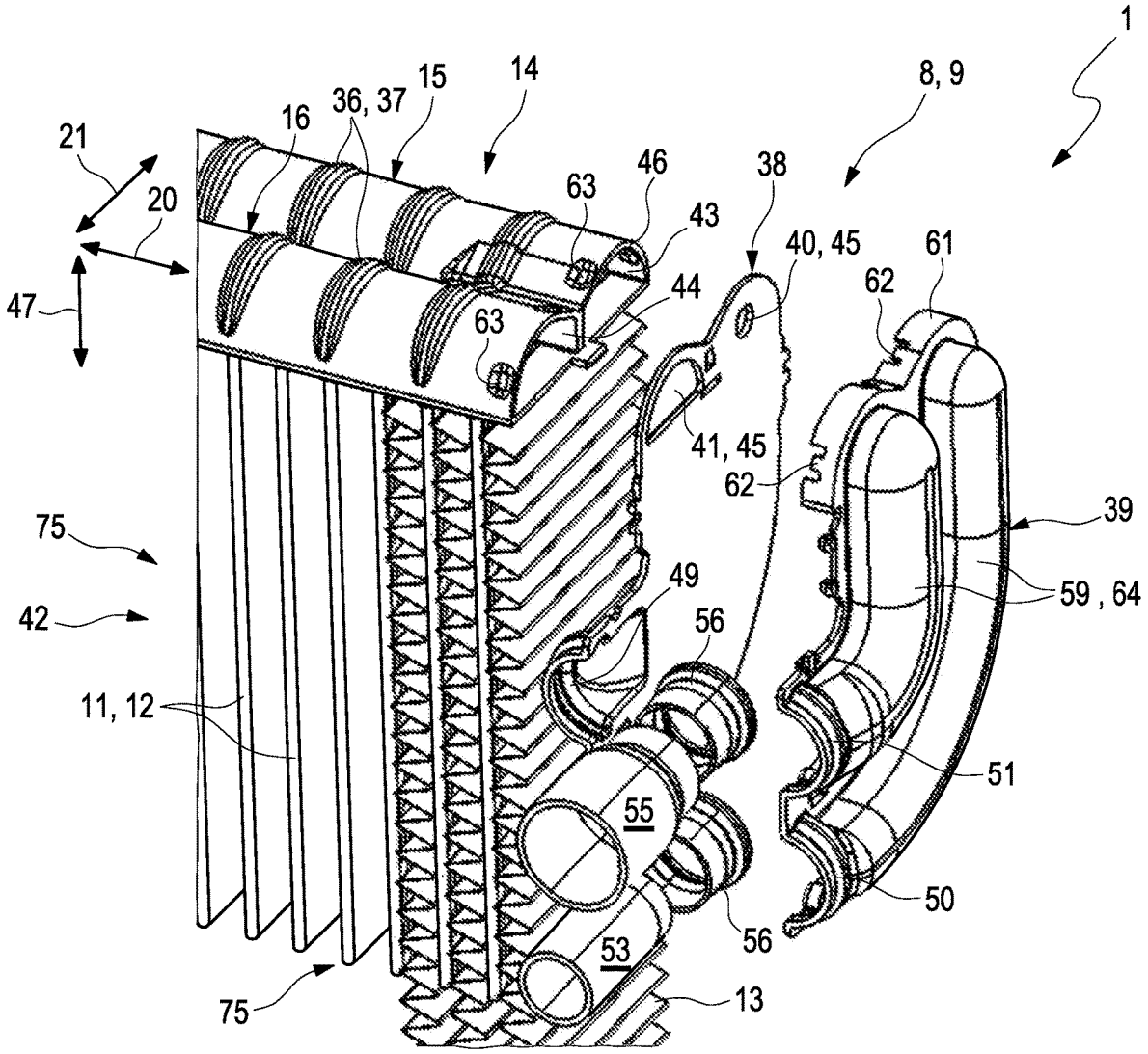
FIG. 3 shows an isometric partial view of the air conditioning system comprising the connector assembly in exploded illustration.

According to FIGS. 2 to 4, the connector assembly 25 has a base plate 38 as well as an outer shell 39. The base plate 38 has a first plate opening 40 and a second plate opening 41. The base plate 38 abuts on a front side 46 of a pipe bundle 42, which consists of the heat exchanger pipes 11 and the at least one collecting tank 14. The first plate opening 40 is thereby fluidically connected to a first collecting pipe opening 43 on the front side or longitudinal end side, respectively, of the first collecting pipe 15 in a fluidic manner, whereas the second plate opening 41 is fluidically connected to a second collecting pipe opening 44 on the front side or longitudinal end side, respectively, of the second collecting pipe 16. The respective plate opening 40, 41 is embodied as an aperture 45 in the base plate 38. The base plate 38 extends in the transverse direction 21 as well as in a height direction 47, which runs transversely to the transverse direction 21 and longitudinal direction 20, and abuts on the front side 46 of the collecting tank 14 as well as on the adjacent, outer corrugated fin 13. On the end of the base plate 38, which is spaced apart from the collecting tank 14, a first plate molding 48 protrudes from the corrugated fin 13 in the transverse direction 21, and a second plate molding 49 adjacent thereto in the height direction 48 and offset to the collecting tank 14. The outer shell 39 follows the course of the base plate 38 and has a first shell molding 50 located opposite the first plate molding 48, and a second shell molding 51 located opposite the second plate molding 49. The first plate molding 48, together with the first shell molding 50, forms a first pipe accommodation 42 for a first supply pipe body 53, whereas the second plate molding 49 forms, with the second shell molding 51, a second pipe accommodation 54, which is separate from the first pipe accommodation 52 and is spaced apart in the height direction 47, for a second supply pipe body 55 of the assembly 25. The respective supply pipe body 53, 55 has a pipe-shaped adapter element 56, which is accommodated in the corresponding pipe accommodation 52, 54 and is enclosed in a positive manner in such a way that the supply pipe body 53, 55 is fastened in the corresponding pipe accommodation 52, 54 in a mechanically stable manner. Even through the respective supply pipe body 53, 55 is illustrated so as to be spaced apart from the corresponding adapter element 56 in FIG. 3, the respective supply pipe body 53, 55 and the corresponding adapter element 56 can be made integrally, in particular monolithically, so that no separate connection between the adapter element 56 and the corresponding supply body 53, 55 is necessary.

The first supply pipe body 53 is fluidically connected to the first plate opening 40 and thus to the first collecting pipe 15 via a first supply duct 57 connected to the first accommodation 52. In contrast, the second supply pipe body 55 is fluidically connected to the second plate opening 41 and thus to the second collecting pipe 16 via the second pipe accommodation 54 and a second supply duct 58, which is separated from the first supply duct 57. Coolant is thus introduced into the first accumulating pipe 15 via the first supply pipe body 53, whereas coolant is sucked from the second collecting pipe 16 via the second supply pipe body 55. The respective supply duct 57, 58 thereby connects to the corresponding pipe accommodation 52, 54, and is formed by the base plate 38 as well as a duct section 59 of the outer shell 39, which is embodied by a molding.

As can in particular be gathered from FIG. 3, the first plate opening 40 is smaller, has in particular a smaller cross section than the second plate opening 41. It can further be seen that the second plate opening 41 has a shape, which is adapted to the circular section 33 of the second collecting pipe 16 in the area of the second collecting pipe opening 44, or an adapted cross section, respectively. This means in particular that the cross section of the second plate opening 41 is embodied complementary to the cross section of the second collecting pipe opening 44. The coolant can thereby be sucked from the second collecting pipe 16 particularly effectively and with little loss of pressure.

Figure 7:
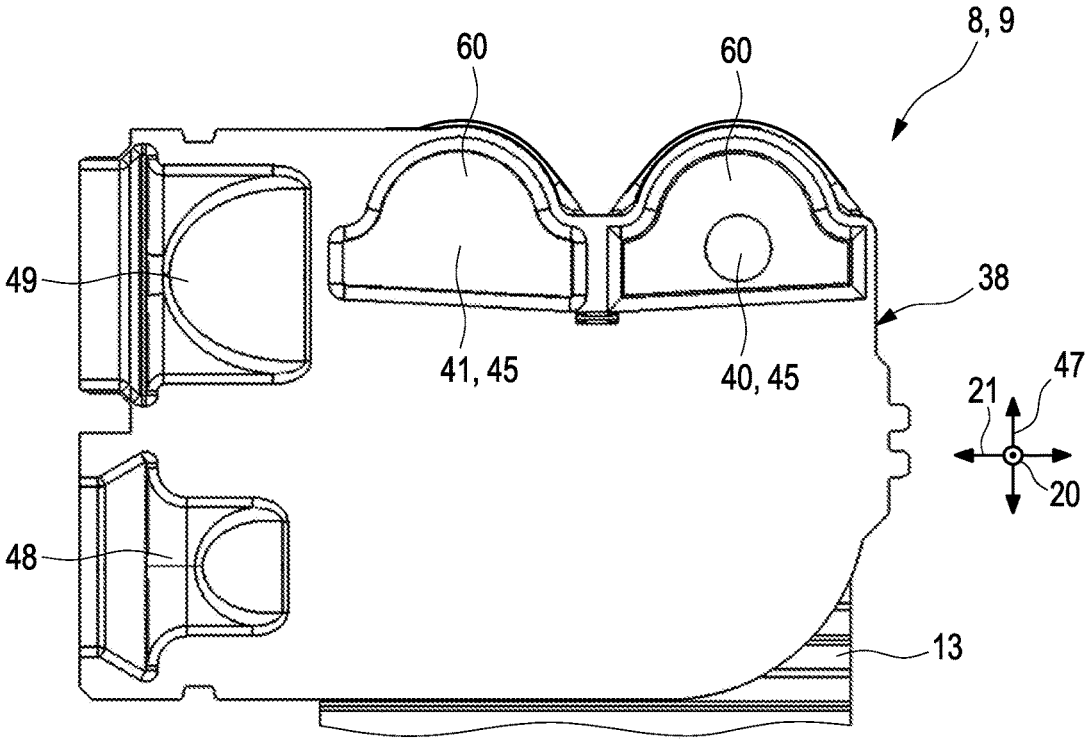
FIG. 7 shows a cross section through the connector assembly in the case of a further exemplary embodiment.

FIG. 7 shows a further exemplary embodiment of the base plate 38, in the case of which the second plate opening 41 has a cross section, which corresponds to the flow cross section 35 of the second collecting pipe 16 in FIGS. 5 and 6, which, in the case of the shown example, preferably also corresponds to the flow cross section 35 of the second collecting pipe opening 44. It can further be seen in FIG. 7 that the plate openings 40, 41 are each arranged in a depression 60, which is directed towards the collecting tank 14, wherein the depressions 60 each slightly penetrate into the corresponding collecting pipe opening 43, 44 and have a form filling one of the corresponding collecting opening 43, 44. The second plate opening 41 is thereby embodied in the entire corresponding depression 60, whereas the first plate opening 40 has a round form and is arranged approximately in the center in the corresponding depression 60. It can also be seen that the depressions 60 follow the inclined course of the bottoms 17.

In the case of the exemplary embodiment shown in FIG. 7, the first plate molding 48 differs from the second plate molding 49, so that the first pipe accommodation 52 also differs from the second pipe accommodation 54. The adapter element 56 of the first supply pipe body 53 and the adapter element 56 of the second supply pipe body 55 are thus embodied differently in this exemplary embodiment. In contrast, the respective pipe accommodation 52, 54 is embodied identically in FIGS. 2 to 4, so that the adapter elements 56 of both supply pipe bodies 53, 55 are embodied identically as well. It can further be seen in FIG. 3 that the first supply pipe body 53 outside of the corresponding adapter element 56 is smaller than the second supply pipe body 55 and has a correspondingly smaller flow cross section.

The base plate 38, the outer shell 39 as well as the supply pipe bodies 53, 55, in particular the adapter elements 56, are preferably joined to one another integrally by means of a joint process, whereby it is preferred when they are soldered to one another. For this purpose, the outer shell 39 and the base plate 38 can be solder-plated at least on one side. The respective adapter element 56 can thereby be placed in the corresponding plate molding 48, 49, and the outer shell 39 can subsequently be brought into contact with the base plate 38, and can be fixed thereto so as to attain the form of the connector assembly 25 shown in FIGS. 2 and 4, wherein the assembly 25 is joined integrally subsequently, in particular soldered. It is also conceivable to join the assembly 25 integrally, in particular to weld it, together with further parts of the heat exchanger 9. In addition to the production of the connector assembly 25, a connection of the connector assembly 25 to the remaining heat exchanger 9 is simultaneously attained as well thereby. In this case, as little solder as possible is attached to the side of the base plate 38 facing away from the outer shell 39, in particular a solder-plating comprising a solder portion of less than 5%, so as to prevent or so as to at least reduce a combustion or damages, respectively, to the adjacent corrugated fin 13.

As can in particular be gathered from FIGS. 2 to 4, the outer shell 39 has, in the area of the plate openings 40, 41, a handle section 61, which protrudes on the edge side, follows the form of the collecting tank 41 and of the base plate 38, and which protrudes beyond the base plate 38 on the edge side. The handle section 61 encompasses the front side 46 of the collecting tank 14 on the edge side and is mechanically connected to the collecting tank 14 via a plurality of connecting elements 62, which are arranged so as to be distributed and which interact in a positive manner with mating connecting elements 63 provided on the walls 18 of the collecting pipes 15, 16. The collecting pipe openings 43, 44 and the base plate 38 are thereby encompassed by the handle section 61 on the edge side, because the handle section 61 abuts on the outer side of the wall 18 of the respective collecting pipe 15, 16. This stabilizes the connection between the collecting tank 14 and the connector assembly 25 and leads to smaller pressure losses in the coolant or to an improved sealing, respectively, of the flow path of the coolant. The connecting elements 62 and mating connecting elements 63 can further be used to fix the assembly 25 in a relative manner to the remaining heat exchanger 9 prior to an integral joining.

In the case of the shown examples, both pipe accommodations 52, 54 extend along the base plate 38, so that they are oriented perpendicularly to the corresponding plate opening 40, 41 or so that the pipe accommodations 52, 54 can each be flown through in a plane, which runs perpendicular to the corresponding plate opening 40, 41, respectively. The respective supply duct 57, 58 thereby runs in a curved manner, in particular by 90°.

As shown in FIG. 5, the collecting tank 14 has a tank height 65, which runs in the height direction 47, which can be less than 48 mm, in particular less than 46 mm, for example between 40 mm and 43 mm, in particular between 41.5 mm and 42.5 mm. A corresponding height 66 of the passages 30, hereinafter referred to as passage height 66, can be less than 3 mm, preferably less than 2.5 mm and 2.2 mm, particularly preferably 2 mm.

A height 76, which runs in the height direction 47, of a net 75, which consists of the heat exchanger pipes 11 and corrugated fins 13, of the heat exchanger 9, also referred to as net height 76 (see also FIG. 4) is preferably less than 45 mm, in particular less than 42 mm. Advantageously, the net height 76 is between 39 mm and 40 mm, in particular between 39.4 mm and 40 mm.

Figure 9:
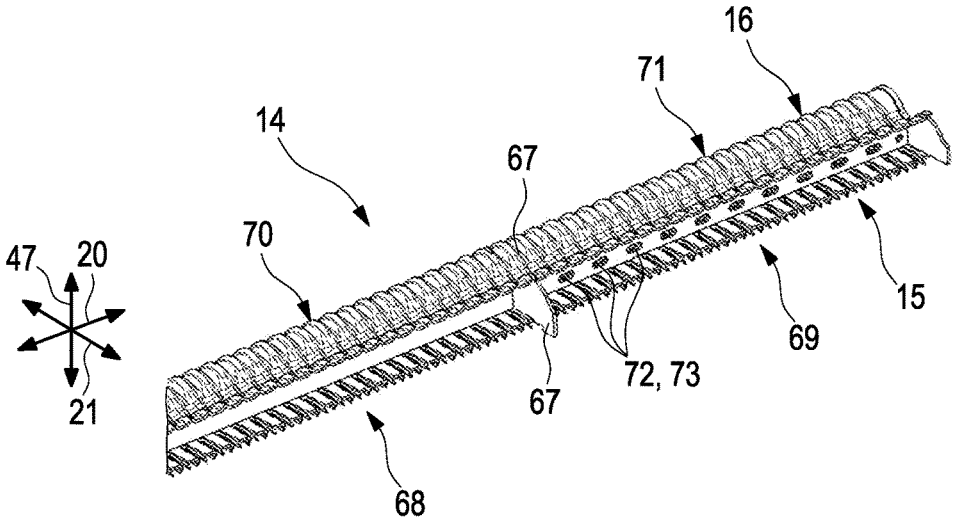
FIG. 9 shows an isometric view of the collecting tank with open illustration of the first collecting pipe.

An isometric view of the collecting tank 14 is shown in FIG. 9 in the case of another exemplary embodiment. This collecting tank 14 is thereby illustrated so as to be open in the area of the first collecting pipe 15. It can be seen that a separating wall 67 is arranged inside the first collecting pipe 15. Inside the first collecting pipe 15, the separating wall 67 separates a first pipe section 68 of the first collecting pipe 15 from a second pipe section 69 of the first collecting pipe 15. The first pipe section 68 of the first collecting pipe 15 thereby comprises the first collecting pipe opening 43, through which the coolant is let in. An analogous separating wall 67, which is only suggested in FIG. 9, is arranged in the second collecting pipe 16 and separates a first pipe section 70 of the second collecting pipe 16 from a second pipe section 71 of the second collecting pipe 16 inside the second collecting pipe 16. The first pipe section 70 of the second collecting pipe 16 thereby comprises the second collecting pipe opening 44, out of which the coolant is sucked. The first collecting pipe 15 and the second collecting pipe 16 are thus each divided into two pipe sections 68, 69, 70, 71, which are fluidically separated from one another inside the corresponding collecting pipe 15, 16. It can further be seen in FIG. 9 that the second pipe section 69 of the first collecting pipe 15 and the second pipe section 71 of the second collecting pipe 16 are fluidically connected to one another by means of at least one fluidic connection 72 inside the collecting tank 14. In the shown example, a plurality of such connections 72, which are distributed in the longitudinal direction 20, are thereby provided. The fluidic connections 72 are thereby each embodied as wall apertures 73 in the wall 18 of the respective second pipe section 69, 71.

Figure 10:
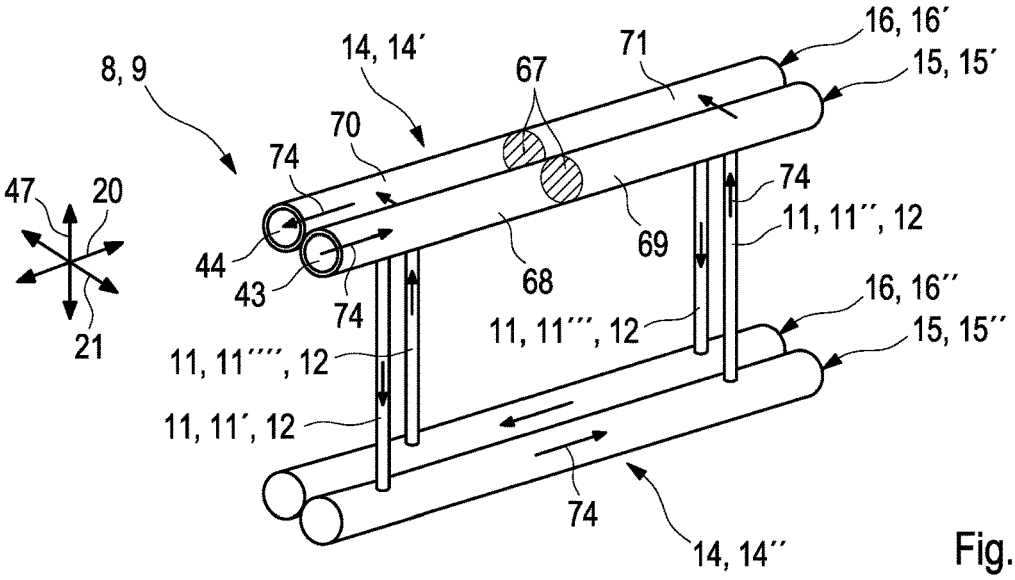
FIG. 10 shows a highly simplified, isometric view of the heat exchanger.

FIG. 10 shows a highly simplified illustration of the heat exchanger 9. The heat exchanger 9 has two collecting tanks 14, namely a first collecting tank 14, 14', as well as a second collecting tank 14, 14". The respective collecting tank 14 has two collecting pipes 15, 16, wherein, for better differentiation, the collecting pipes 15, 16 of the first collecting tank 14' are referred to as first collecting pipe 15' and second collecting pipe 16', whereas the collecting pipes 15, 16 of the second collecting tank 14" are referred to as third collecting pipe 15" and fourth collecting pipe 16". The first collecting tank 14' thereby corresponds to the collecting tank 14 shown in FIG. 9, in the case of which a separating wall 67, which is suggested by means of shading, is in each case provided in the first collecting pipe 15' and in the second collecting pipe 16', so that the first collecting pipe 15' has the first pipe section 68 comprising the first collecting pipe opening 43 and the second pipe section 69, while the second collecting pipe 16' has the first pipe section 70 comprising the second collecting pipe opening 44 and the second pipe section 71, which is connected to the second pipe section 69 of the second collecting pipe 15' in the first collecting tank 14'. In contrast, no separating walls 67 and no collecting pipe openings 43, 44 are provided in the third collecting pipe 15" and fourth collecting pipe 16". The first pipe section 68 of the first collecting pipe 15' is thereby fluidically connected to the third collecting pipe 15" via heat exchanger pipes 11, hereinafter also referred to as first heat exchanger pipes 11'. The third collecting pipe 15" is furthermore connected to the second pipe section 69 of the first collecting pipe 15' by other heat exchanger pipes 11, hereinafter referred to as second heat exchanger pipes 11". Other heat exchanger pipes 11, in turn, hereinafter referred to as third heat exchanger pipes 1'", connect the second pipe section 71 of the second collecting pipe 16' to the fourth collecting pipe 16". Further heat exchanger pipes 11, hereinafter referred to as fourth heat exchanger pipes 11"", fluidically connect the fourth collecting pipe 16" to the first pipe section 70 of the second collecting pipe 16'. A first heat exchanger pipe 11', a second heat exchanger pipe 11", a third heat exchanger pipe 11'" as well as a fourth heat exchanger pipe 11"" are thereby shown in FIG. 10 in a purely exemplary manner and for the sake of clarity. The heat exchanger pipes 11 thereby run essentially parallel to one another and extend in the height direction 47. If coolant is introduced for example via the first supply pipe body 53, it flows, as suggested with flow arrows 74, via the first collecting pipe opening 43 into the first pipe section 68 of the first collecting pipe 15 and subsequently via the first heat exchanger pipes 11' into the third collecting pipe 15" and subsequently via the second heat exchanger pipes 11" into the second pipe section 69 of the first collecting pipe 15', Here, the coolant reaches via the fluidic connections 72 into the second pipe section 71 of the second collecting pipe 16' and flows via the third heat exchanger pipes 11'" into the fourth collecting pipe 16" and subsequently via the fourth heat exchanger pipes 11"" into the first pipe section 70 of the second collecting pipe 16' and flows out via the second collecting pipe opening 44.

The invention claimed is:

1. A heat exchanger, comprising:

a first collecting tank including a first collecting pipe and a second collecting pipe, the first collecting pipe having a first collecting pipe opening for letting in a fluid, and the second collecting pipe having a second collecting pipe opening for discharging the fluid;

a second collecting tank arranged opposite the first collecting tank and including a third collecting pipe and a fourth collecting pipe;

a plurality of heat exchanger pipes fluidically connecting the first collecting pipe to the third collecting pipe and the second collecting pipe to the fourth collecting pipe;

a separating wall arranged in each of the first collecting pipe and the second collecting pipe respectively dividing the first collecting pipe and the second collecting pipe into a first pipe section and a second pipe section;

a connector assembly configured to fluidically supply the first collecting tank, the connector assembly including a base plate, an outer shell, and two supply pipe bodies;

wherein the second pipe section of the first collecting pipe and the second pipe section of the second collecting pipe are fluidically connected in the first collecting tank such that the fluid is flowable through, in order, the first collecting pipe opening, the first pipe section of the first collecting pipe, the plurality of heat exchanger pipes, the third collecting pipe, the plurality of heat exchanger pipes, the second pipe section of the first collecting pipe, the second pipe section of the second collecting pipe, the plurality of heat exchanger pipes, the fourth collecting pipe, the plurality of heat exchanger pipes, the first pipe section of the second collecting pipe, the second collecting pipe opening;

wherein the base plate has a first plate opening fluidically connected to the first collecting pipe opening and a second plate opening fluidically connected to the second collecting pipe opening;

wherein a first pipe accommodation for a first supply pipe body and a second pipe accommodation for a second supply pipe body are defined by the base plate and the outer shell;

wherein the two supply pipe bodies each include a respective adapter element via which the two supply pipe bodies are arranged within a corresponding pipe accommodation and enclosed in a positive manner;

wherein a first supply duct extends from the first pipe accommodation to the first plate opening; and wherein a second supply duct, which is fluidically separated from the first supply duct, extends from the second pipe accommodation to the second plate opening.

2. The heat exchanger according to claim 1, wherein the first pipe section of the first collecting pipe includes the first collecting pipe opening, and the first pipe section of the second collecting pipe includes the second collecting pipe opening.

3. The heat exchanger according to claim 1, wherein the plurality of heat exchanger pipes includes:

a plurality of first heat exchanger pipes fluidically connecting the first pipe section of the first connecting pipe to the third collecting pipe;

a plurality of second heat exchanger pipes fluidically connecting the third collecting pipe to the second pipe section of the first collecting pipe;

a plurality of third heat exchanger pipes fluidically connecting the second pipe section of the second collecting pipe to the fourth collecting pipe; and a plurality of fourth heat exchanger pipes fluidically connecting the fourth collecting pipe to the first pipe section of the second collecting pipe.

4. The heat exchanger according to claim 1, wherein the first collecting pipe, the second collecting pipe, the third collecting pipe, and the fourth collecting pipe have a respective flattened bottom including a plurality of passages directed to an outside and structured to accommodate the plurality of heat exchanger pipes.

5. The heat exchanger according to claim 1, wherein each of the plurality of heat exchanger pipes has a shoulder arranged against a corresponding collecting pipe on a front side.

6. The heat exchanger according to claim 4, wherein the respective flattened bottom of at least one of i) the first collecting pipe and the second collecting pipe, and ii) the third collecting pipe and the fourth collecting pipe, extend at an incline relative to one another and define a predetermined angle $\alpha$, which is not equal to 180°.

7. The heat exchanger according to claim 4, wherein:

at least one of the first collecting pipe and the second collecting pipe includes a wall connected to the respective flattened bottom and forming a flow cross section with the respective flattened bottom; and the wall has a circular section in the shape of a circular segment disposed opposite the respective flattened bottom and a plurality of transition sections connected thereto on both sides, which transition into the respective flattened bottom.

8. The heat exchanger according to claim 7, wherein the second plate opening has a cross section, which has a shape corresponding to a portion of the flow cross section disposed within the circular section, and is arranged aligned with the circular section and is fluidically connected to the second collecting pipe opening.

9. The heat exchanger according to claim 1, wherein:

the first collecting pipe opening and the second collecting pipe opening are arranged on a front side of the first collecting tank; and the base plate abuts on the front side of the first collecting tank such that the first plate opening and the second plate opening are arranged aligned with and directly fluidically connected to the first collecting pipe opening and the second collecting pipe opening respectively.

10. The heat exchanger according to claim 1, wherein:

the base plate includes a first plate molding and a second plate molding that each protrude from the base plate away from the outer shell;

the outer shell includes a first shell molding and a second shell molding that each protrude from the outer shell away from the base plate;

the base plate and the outer shell are coupled to one another such that (i) the first plate molding and the first shell molding define the first pipe accommodation and (ii) the second plate molding and the second shell molding define the second pipe accommodation.

11. The heat exchanger according to claim 10, wherein:

at least a portion of the first supply duct is defined by and between the first shell molding and a planar portion of the base plate; and at least a portion of the second supply duct is defined by and between the second shell molding and the planar portion of the base plate.

12. The heat exchanger according to claim 6, wherein the predetermined angle $\alpha$ is less than or equal to 174°.

13. A heat exchanger comprising:

a plurality of collecting pipes having a respective flattened bottom including a plurality of passages directed to an outside, the plurality of collecting pipes including a first collecting pipe, a second collecting pipe, a third collecting pipe, and a fourth collecting pipe, the first collecting pipe and the second collecting pipe respectively divided into a first pipe section and a second pipe section via a separating wall arranged therein;

a first collecting tank including the first collecting pipe and the second collecting pipe, the first collecting pipe having a first collecting pipe opening configured to let in a fluid, and the second collecting pipe having a second collecting pipe opening for discharging the fluid;

a second collecting tank arranged opposite the first collecting tank and including the third collecting pipe and the fourth collecting pipe; and a plurality of heat exchanger pipes coupled to the plurality of passages and fluidically connecting the first collecting pipe to the third collecting pipe and the second collecting pipe to the fourth collecting pipe;

a connector assembly configured to fluidically supply the first collecting tank, the connector assembly including a base plate, an outer shell, a first supply pipe body, and a second supply pipe body;

wherein the second pipe section of the first collecting pipe and the second pipe section of the second collecting pipe are fluidically connected in the first collecting tank such that the fluid is flowable through, in order, the first collecting pipe opening, the first pipe section of the first collecting pipe, the plurality of heat exchanger pipes, the third collecting pipe, the plurality of heat exchanger pipes, the second pipe section of the first collecting pipe, the second pipe section of the second collecting pipe, the plurality of heat exchanger pipes, the fourth collecting pipe, the plurality of heat exchanger pipes, the first pipe section of the second collecting pipe, the second collecting pipe opening;

wherein the base plate includes a first plate molding and a second plate molding that each protrude from the base plate away from the outer shell;

wherein the outer shell includes a first shell molding and a second shell molding that each protrude from the outer shell away from the base plate;

wherein the base plate and the outer shell are coupled to one another such that (i) the first plate molding and the first shell molding define a first pipe accommodation for the first supply pipe body and (ii) the second plate molding and the second shell molding define a second pipe accommodation for the second supply pipe body;

wherein the first supply pipe body includes a first adapter element via which the first supply pipe body is arranged within the first pipe accommodation and enclosed in a positive manner; and wherein the second supply pipe body includes a second adapter element via which the second supply pipe body is arranged within the second pipe accommodation and enclosed in a positive manner.

14. The heat exchanger according to claim 13, wherein:

the base plate has a first plate opening fluidically connected to the first collecting pipe opening and a second plate opening fluidically connected to the second collecting pipe opening;

the connector assembly further includes a first supply duct extending from the first pipe accommodation to the first plate opening; and the connector assembly further includes a second supply duct, fluidically separated from the first supply duct, extending from the second pipe accommodation to the second plate opening.

15. The heat exchanger according to claim 14, wherein:

at least a portion of the first supply duct is defined by and between the first shell molding and a planar portion of the base plate; and at least a portion of the second supply duct is defined by and between the second shell molding and the planar portion of the base plate.

16. A heat exchanger comprising:

a plurality of collecting pipes including a first collecting pipe, a second collecting pipe, a third collecting pipe, and a fourth collecting pipe, the first collecting pipe and the second collecting pipe respectively divided into a first pipe section and a second pipe section via a separating wall arranged therein;

a first collecting tank including the first collecting pipe and the second collecting pipe, the first collecting pipe having a first collecting pipe opening configured to let in a fluid, and the second collecting pipe having a second collecting pipe opening for discharging the fluid, the first collecting pipe opening and the second collecting pipe opening arranged on a front side of the first collecting tank;

a second collecting tank arranged opposite the first collecting tank and including the third collecting pipe and the fourth collecting pipe;

a plurality of heat exchanger pipes fluidically connecting the first collecting pipe to the third collecting pipe and the second collecting pipe to the fourth collecting pipe;

a connector assembly configured to fluidically supply the first collecting tank including a base plate having a first plate opening and a second plate opening, the base plate arranged against the front side of the first collecting tank such that the first plate opening and the second plate opening are arranged aligned with and directly fluidically connected to the first collecting pipe opening and the second collecting pipe opening respectively;

wherein the connector assembly further includes an outer shell arranged on the base plate opposite the front side of the first collecting tank, the outer shell including a handle section projecting therefrom toward the first collecting tank via which the outer shell is coupled to the first collecting tank;

wherein the handle section projects beyond and at least partially surrounds the base plate, the first collecting pipe opening, and the second collecting pipe opening;

wherein the second pipe section of the first collecting pipe and the second pipe section of the second collecting pipe are fluidically connected in the first collecting tank such that the fluid is flowable through, in order, the first collecting pipe opening, the first pipe section of the first collecting pipe, the plurality of heat exchanger pipes, the third collecting pipe, the plurality of heat exchanger pipes, the second pipe section of the first collecting pipe, the second pipe section of the second collecting pipe, the plurality of heat exchanger pipes, the fourth collecting pipe, the plurality of heat exchanger pipes, the first pipe section of the second collecting pipe, the second collecting pipe opening.

17. The heat exchanger according to claim 1, wherein:

the outer shell includes a handle section projecting therefrom toward the first collecting tank via which the outer shell is coupled to the first collecting tank; and the handle section projects beyond and at least partially surrounds the base plate, the first collecting pipe opening, and the second collecting pipe opening.

18. The heat exchanger according to claim 17, wherein:

the first collecting pipe, the second collecting pipe, the third collecting pipe, and the fourth collecting pipe have a respective flattened bottom and a respective wall, the respective wall connected to the respective flattened bottom forming a flow cross section therewith; and the handle section extends along and is coupled to the respective wall of the first collecting pipe and the respective wall of the second collecting pipe.

19. The heat exchanger according to claim 1, wherein:

the two supply pipe bodies are structured separately and independently from the respective adapter element; and the respective adapter element of the first supply pipe body and the respective adapter element of the second supply pipe body are structured differently than one another.

20. The heat exchanger according to claim 8, wherein the first plate opening has a cross section that is smaller than and has a different shape than the cross section of the second plate opening.

* * * * *